United States Patent [19]

Schultz et al.

[11] 4,087,321

[45] May 2, 1978

[54] HEAD BOX HAVING DISTRIBUTOR PIPE CONNECTED TO A PULP GUIDE BLOCK

[75] Inventors: Hans-Joachim Schultz; Wolf-Gunter Stotz, both of Ravensburg, Germany

[73] Assignee: Escher Wyss GmbH, Ravensburg, Germany

[21] Appl. No.: 752,092

[22] Filed: Dec. 20, 1976

[30] Foreign Application Priority Data

Jan. 23, 1976 Switzerland ..... 817/76

[51] Int. Cl.[2] ..... D21F 1/02; D21F 1/06

[52] U.S. Cl. ..... 162/343; 162/344

[58] Field of Search ..... 162/336, 343, 344, 347, 162/317, 301, 216, 214, 374

[56] References Cited

U.S. PATENT DOCUMENTS

| | | | |
|---|---|---|---|
| 3,098,787 | 7/1963 | Sieber | 162/343 X |
| 3,272,233 | 9/1966 | Trufitt | 162/343 X |
| 3,373,080 | 3/1968 | Appel et al. | 162/343 |
| 3,393,123 | 7/1968 | Klingler et al. | 162/374 X |
| 3,528,882 | 9/1970 | Notbohm | 162/347 X |
| 3,962,031 | 6/1976 | Babik et al. | 162/343 X |

*Primary Examiner*—Richard V. Fisher

*Attorney, Agent, or Firm*—Kenyon & Kenyon, Reilly, Carr & Chapin

[57] ABSTRACT

The distribution pipe is of narrowing circular cross-section with an elongated aperture. The pulp guide is mounted via a tongue and groove connection on the pipe to both sides of the aperture in order to hold the pipe together against the peripherally operative tangential force of the pipe. The plates which form the throat can be replaced from time-to-time to change the size of the throat.

5 Claims, 3 Drawing Figures

HEAD BOX HAVING DISTRIBUTOR PIPE CONNECTED TO A PULP GUIDE BLOCK

This invention relates to a head box for a paper making machine.

As is known, paper-making machines employ head boxes to distribute pulp which is supplied from a source onto at least one wire. Generally, these head boxes are constructed of a distributor which is connectable to a pulp source and a pulp guide which is adapted to provide uniform distribution of the flow of pulp from the distributor into a throat of the head box. The throat is usually formed by two lips, e.g. in the form of plates, and supplies the pulp to at least one wire.

Since today's conventional high-output machines feed the pulp at a pressure considerably higher than atmospheric pressure, the distributor and the lips of head boxes of the kind described are required to withstand considerable forces. This factor leads to heavy and expensive constructions such as are disclosed e.g. by U.S. Pat. Nos. 3,909,349 and 3,321,360.

Accordingly, it is an object of the invention to provide a head box which has an optimum force flow in the distributor and in the pulp guide and which can therefore be much simpler and cheaper than the known head boxes.

It is another object of the invention to provide a head box of relatively simple construction.

Briefly, the invention provides a head box for a paper-making machine which comprises a distributor for receiving a flow of pulp, a pulp guide for uniformly distributing the flow of pulp from the distributor and a throat for receiving a uniform flow of pulp from the pulp guide for distribution onto at least one wire.

The distributor has a distribution pipe of narrowing circular cross-section in the direction of pulp flow and an elongated aperture in the distribution pipe which extends longitudinally of the pipe. The pulp guide is mounted over the aperture of the distribution pipe to hold the pipe together along the aperture. To this end, the pulp guide is in the form of a metal block and a tongue and groove connection is formed between the pipe and the block on each longitudinal side of the pipe aperture. In addition, the block has a plurality of ducts which extend therethrough for the passage of pulp from the pipe.

Each tongue and groove connection includes an edging which is secured to the pipe along the aperture and which has a projection while a corresponding groove is formed in the pulp guide block to receive the projection. This provides a simple and reliable positive connection of the distribution pipe edges to the block of the pulp guide.

The distribution pipe can have at least one conical portion as a conical shape is hydraulically satisfactory and is simple to produce. For instance, the distribution pipe can be embodied by a number of conical surfaces which are connected to one another lengthwise of the pipe and which have different angles of inclination.

The throat is formed of a pair of plates which define two lips and are secured to opposite sides of the pulp guide. The resulting head box is very simple, for unlike the conventional head boxes, the lips of such a head box do not have to be supported on complicated support members. This feature becomes possible as a result of the pulp guide being embodied as a metal block. This feature is particularly advantageous in cases where, as in double-wire paper-making machines, the stream of pulp issues from the head box between two cylinders over which wires are trained and the exit throat is required to be disposed very far into the bight or gap between the two cylinders.

Preferably, the plates which define the throat can be screwed tight to the block, the plates then being readily replaceable, e.g. when the throat width is to be changed.

These and other objects and advantages of the invention will become more apparent from the following detailed description and appended claims taken in conjunction with the accompanying drawings in which:

Figure 1:
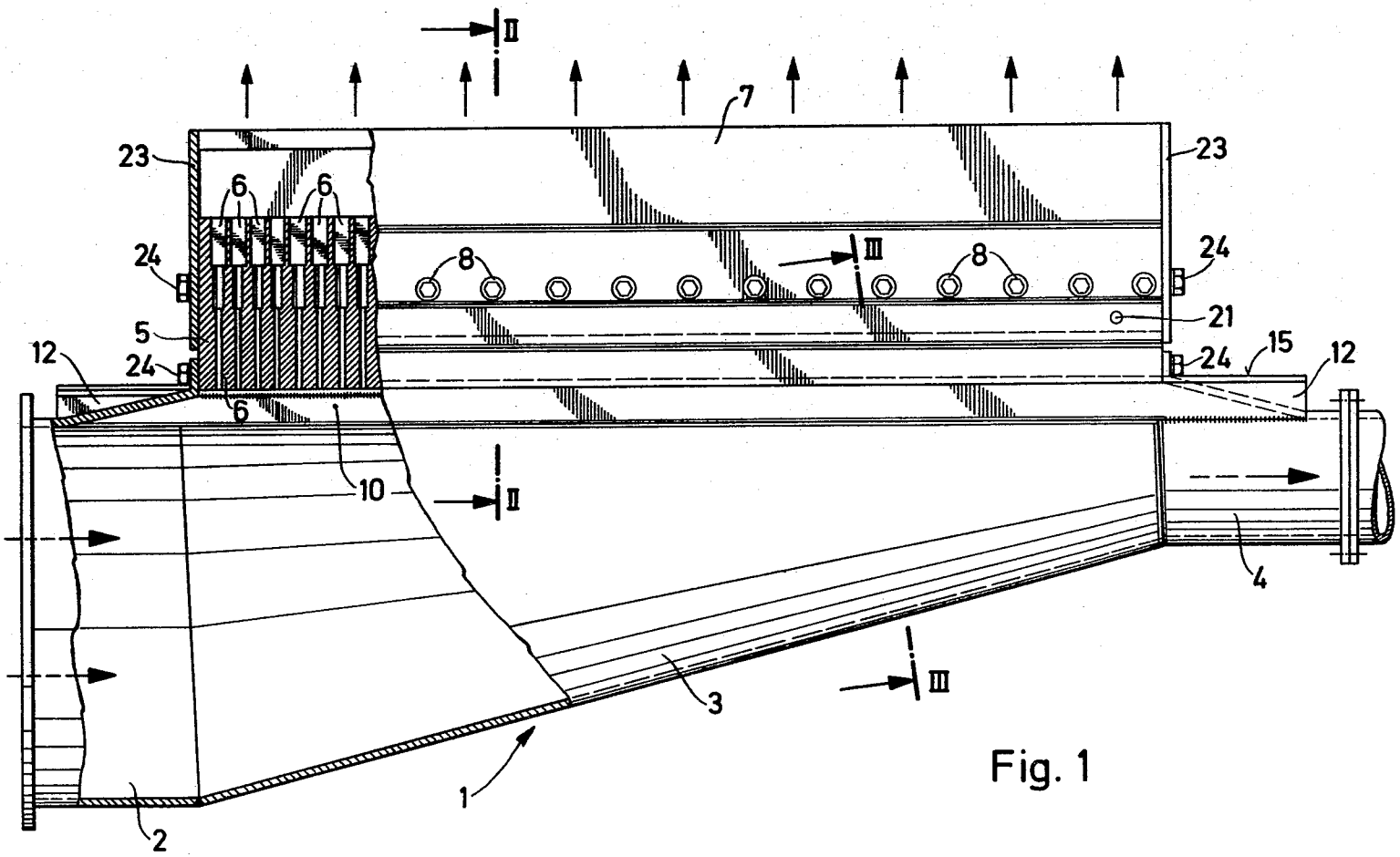
FIG. 1 illustrates a side elevational view with partial sectioning of a head box according to the invention.

Referring to FIG. 1, the head box has a distributor 1 which includes a cylindrical pipe portion 2, a conical distribution pipe 3 and a cylindrical overflow pipe 4. The pipe section 2 is adapted to be connected to a suitable pulp source (not shown) so as to receive a flow of pulp. The distribution pipe 3 is of narrowing cross-section in the direction of pulp flow.

A pulp guide 5 in the form of a metal block, for example of corrosion-free steel, with a plurality of ducts 6 is mounted on the conical distribution pipe 3. As shown, the ducts 6 widen in step-wise fashion in the pulp flow direction. In addition, a pair of plates 7 are secured laterally to the block 5 by bolts 8 and are spaced from each other to define a pulp delivery throat S.

Figure 2:
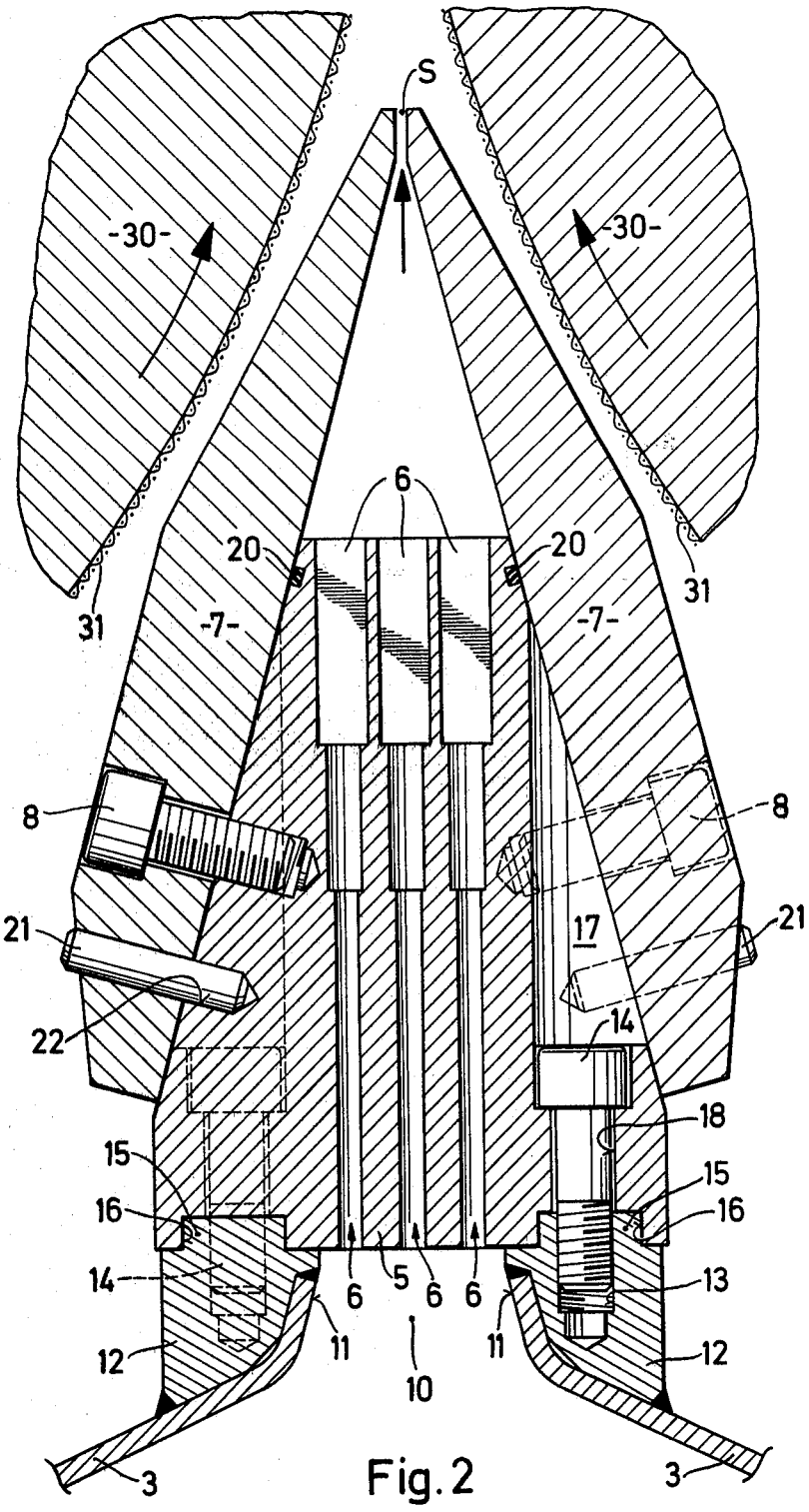
FIG. 2 illustrates a view in partial section taken on line II—II of FIG. 1.
Figure 3:
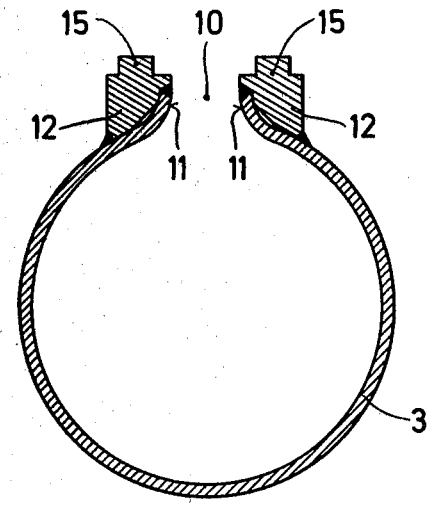
FIG. 3 illustrates a view in partial section of the distribution pipe taken on line III—III of FIG. 1.

Referring to FIG. 2, the distribution pipe 3 has an elongated aperture or slot 10 which extends longitudinally of the pipe 3 while the ducts 6 in the pulp guide block 5 are in communication with the aperture 10 so that pulp can flow from the interior of the pipe through the ducts 6 to the throat S. A tongue and groove connection serves to secure the guide block 5 to the pipe 3 on both sides of the aperture 10. To this end, strengthening edgings 12 are secured, as by welding, to the edges 11 of the pipe 3 along the aperture 10. These edgings 12 are formed with tapped bores 13 to receive bolts 14 by which the block 5 is secured in place on the pipe 3. The edgings 12 also have elongated projections 15 (see FIG. 3) which engage in corresponding grooves 16 in the block 5. The block 5 is formed with cylindrical recesses 17 and 18 to accommodate and cooperate with the bolts 14.

As can also be gathered from FIG. 2, cord gaskets 20 are provided between the plates 7 and the pulp guide 5 and the plates 7 are secured to the block 5 by pins 21 and bores 22.

Referring to FIG. 1, end plates 23 are secured via bolts 24 to the ends of the block 5 and serve to provide a lateral boundary for the pulp flow path.

When in use, pulp is delivered via the pipe portion 2 to the pipe 3 of narrowing cross-section. The pulp then passes through the aperture 10 into and through the ducts 6 in the block 5 and is uniformly distributed by the ducts 6 along the length and breadth of the block 5. The pulp then passes through the throat S for distribution onto the wires 31 on the cylinders 30.

During use, the distributor 1 experiences a considerable positive pressure, since the feed pressure of the pulp in high-output machines may be as much as 10 kiloponds per square centimeter (kp/cm$^2$). The resulting load is received in ideal manner by the circular cross-section of the pipe 3 and the pipe portions 2, 4. The flow of force along the aperture 10 extends through the edgings 12 and the block 5 with tangential forces being received by the projections 15 and grooves 16.

Because the plates 7 can be secured quite simply to the pulp guide block 5 by the screws 8, no expensive and heavy support structure is required.

As can be gathered from FIG. 2, the head box can be inserted far into the wedge-shaped gap or bight between two cylinders 30 of a double-wire machine, wires 31 being trained over the cylinders 30.

When it is required to alter the size of shape of the throat S, the screws 8 are released, the plates 7 removed and new plates (lips) provided in their place.

What is claimed is:

1. A head box for a paper making machine comprising a distributor for receiving a flow of pulp, said distributor having a distribution pipe of narrowing circular cross-section in the direction of flow of the pulp and means defining an elongated aperture in said distribution pipe extending longitudinally of said pipe;

a pulp guide for uniformly distributing the flow of pulp from said distributor, said pulp guide being mounted over said aperture of said distribution pipe to hold said pipe together along said aperture and being a metal block having a plurality of ducts extending therethrough for passage of pulp from said distribution pipe;

a connection between said pipe and said block on each longitudinal side of said aperture to receive a peripherally operative tangential force of said pipe; and a pair of plates releaseably secured on said pulp guide in spaced apart relation to define a throat for receiving a uniform flow of pulp from said pulp guide for distribution onto at least one wire.

2. A head box as set forth in claim 1 wherein said distribution pipe has at least one conical portion.

3. A head box as set forth in claim 1 wherein each connection comprises a tongue and groove connection.

4. A head box as set forth in claim 3 wherein each said tongue and groove connection includes an edging secured to said pipe along said aperture, said edging having a tongue of said connection thereon, and a groove of said connection in said block receiving said tongue.

5. A head box for a paper making machine comprising a distributor for receiving a flow of pulp, said distributor having a distribution pipe of narrowing circular cross-section in the direction of flow of the pulp and means defining an elongated aperture in said distribution pipe extending longitudinally of said pipe;

a pulp guide for uniformly distributing the flow of pulp from said distributor, said pulp being a metal block mounted over said aperture of said distribution pipe to hold said pipe together along said aperture, and having a plurality of ducts extending therethrough for passage of pulp from said distribution pipe;

means defining a throat for receiving a uniform flow of pulp from said pulp guide for distribution onto at least one wire; and a connection between said pipe and said block on each longitudinal side of said aperture-defining means to receive a peripherally operative tangential force of said pipe, each said connection including an edging secured to said pipe along said aperture-defining means, said edging having a projection thereon, and a groove in said block receiving said projection.

* * * * *